US010609987B2

(12) United States Patent
Smith

(10) Patent No.: US 10,609,987 B2
(45) Date of Patent: Apr. 7, 2020

(54) FOOTWEAR WITH A SOCK-LIKE UPPER

(71) Applicant: Fuerst Group, Inc., Menlo Park, CA (US)

(72) Inventor: Steven Francis Smith, Lake Oswego, OR (US)

(73) Assignee: Fuerst Group, Inc., Menlo Park, CA (US)

( * ) Notice: Subject to any disclaimer, the term of this patent is extended or adjusted under 35 U.S.C. 154(b) by 586 days.

(21) Appl. No.: 15/133,553

(22) Filed: Apr. 20, 2016

(65) Prior Publication Data

US 2016/0302524 A1 Oct. 20, 2016

Related U.S. Application Data

(60) Provisional application No. 62/150,203, filed on Apr. 20, 2015.

(51) Int. Cl.

| | |
|---|---|
| ***A43B 1/04*** | (2006.01) |
| ***A43B 13/12*** | (2006.01) |
| ***A43C 1/04*** | (2006.01) |
| ***A43B 23/02*** | (2006.01) |

(52) U.S. Cl.

CPC ..... *A43C 1/04* (2013.01); *A43B 1/04* (2013.01); *A43B 13/12* (2013.01); *A43B 23/024* (2013.01); *A43B 23/0255* (2013.01); *A43B 23/0265* (2013.01)

(58) Field of Classification Search

CPC ..... A43C 1/04; A43B 1/04; A34B 13/12
USPC ..... 36/55
See application file for complete search history.

(56) References Cited

U.S. PATENT DOCUMENTS

| | | | | |
|---|---|---|---|---|
| 2,334,659 | A | 11/1943 | Van Arsdale et al. | |
| 6,862,902 | B1 | 3/2005 | Kim | |
| 6,910,288 | B2 * | 6/2005 | Dua | A43B 1/04 36/45 |
| 6,931,762 | B1 * | 8/2005 | Dua | A43B 1/04 12/142 G |
| 7,131,296 | B2 | 11/2006 | Dua et al. | |
| 7,434,336 | B2 * | 10/2008 | Kosted | A43B 1/0081 36/10 |
| 7,774,956 | B2 * | 8/2010 | Dua | A43B 1/04 36/50.1 |
| 7,987,617 | B2 | 8/2011 | Kohatsu et al. | |
| 8,490,299 | B2 * | 7/2013 | Dua | A43B 1/04 36/45 |
| 8,800,172 | B2 * | 8/2014 | Dua | A43B 23/0235 36/50.1 |
| 8,959,959 | B1 * | 2/2015 | Podhajny | A43B 1/04 66/177 |

(Continued)

*Primary Examiner* — Alissa J Tompkins
*Assistant Examiner* — Catherine M Ferreira
(74) *Attorney, Agent, or Firm* — McCoy Russell LLP

(57) ABSTRACT

Articles of footwear with a sock-like upper and methods for constructing thereof are provided. In one embodiment, an upper comprises a first layer including a first interior and a first exterior, a second layer including a second interior and a second exterior, where the first layer and the second layer comprise a same material and are physically coupled at one end of each layer, and a plurality of sub-structural components positioned between the first exterior and the second interior. In this way, manufacturing articles of footwear with a sock-like upper may be simplified, while the comfort and fit of the articles of footwear may be improved.

20 Claims, 7 Drawing Sheets

(56) References Cited

U.S. PATENT DOCUMENTS

| | | | | |
|---|---|---|---|---|
| 9,084,449 | B2 | 7/2015 | Bell et al. | |
| 9,681,704 | B2 * | 6/2017 | Podhajny ..... | A43B 23/0205 |
| 2012/0266362 | A1 | 10/2012 | Craig | |
| 2014/0137434 | A1 | 5/2014 | Craig | |
| 2014/0150295 | A1 | 6/2014 | Dua et al. | |
| 2014/0237856 | A1 * | 8/2014 | Podhajny ..... | A43B 23/0205 36/84 |
| 2015/0013187 | A1 | 1/2015 | Taniguchi et al. | |
| 2015/0342261 | A1 | 12/2015 | Boucher et al. | |
| 2015/0342285 | A1 | 12/2015 | Huffman et al. | |
| 2015/0342286 | A1 | 12/2015 | Huffman et al. | |
| 2016/0058101 | A1 | 3/2016 | Dua et al. | |

* cited by examiner

FOOTWEAR WITH A SOCK-LIKE UPPER

CROSS REFERENCE TO RELATED APPLICATIONS

The present application claims priority to U.S. Provisional Application No. 62/150,203, entitled "FOOTWEAR WITH A SOCK-LIKE UPPER," and filed on Apr. 20, 2015, the entire contents of which are hereby incorporated by reference for all purposes.

BACKGROUND

Articles of footwear, such as running shoes, typically include an upper coupled to a lower. The upper forms a void within the article of footwear such that a foot may be comfortably inserted into the footwear. The upper further secures the foot in the footwear and provides stability for the foot. The lower, or sole structure, attaches to the upper such that the lower is generally in contact with the ground.

Manufacturing such articles of footwear is a labor-intensive process with many components. For example, the upper may comprise many separate parts stitched or cemented together, whereupon lace holes punched out. The parts of the upper may be formed from many different materials, and as a result numerous processes may be utilized to construct a single upper. Care must be taken throughout to ensure that the resulting article of footwear is actually comfortable to wear.

SUMMARY

The present disclosure provides articles of footwear including a sock-like upper and methods for constructing such articles of footwear. In one example, an upper comprises a first layer including a first interior and a first exterior, and a second layer including a second interior and a second exterior, where the first layer and the second layer comprise a same material and are physically coupled at one end of each layer. The upper further comprises a plurality of sub-structural components positioned between the first exterior and the second interior, the plurality of sub-structural components comprising: a heel counter; a shape-retaining foam support; and a toe box. The second layer is pulled over the one or more sub-structural components and the first layer to encompass the first exterior of the first layer and the one or more sub-structural components. The upper further comprises a plurality of straps fixed to the second exterior, and at least one lace coupled to each of the plurality of straps. In this way, manufacturing articles of footwear with a sock-like upper may be simplified, while the comfort and fit of the articles of footwear may be improved.

DETAILED DESCRIPTION

Figure 1:
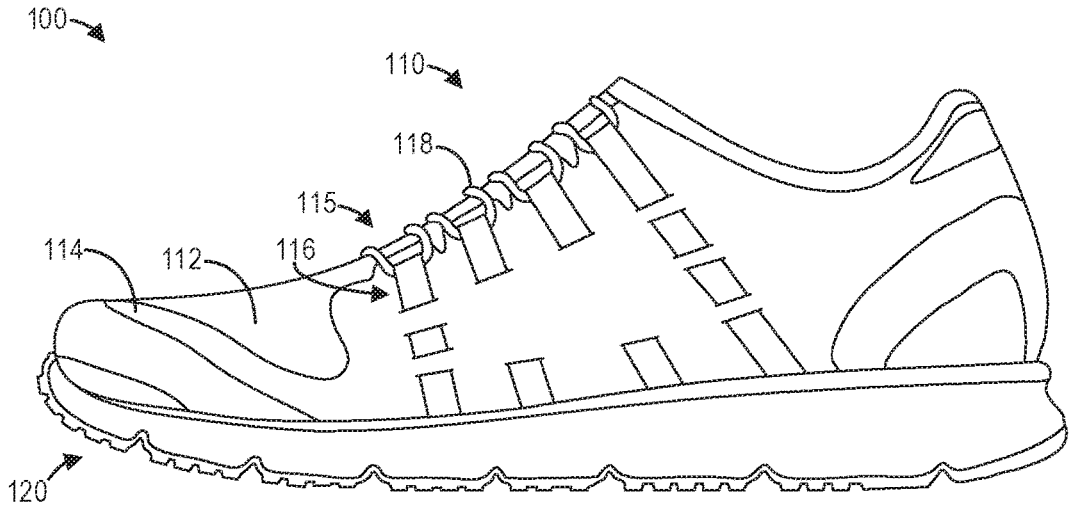
FIG. 1 shows an article of footwear with a sock-like upper.
Figure 2:
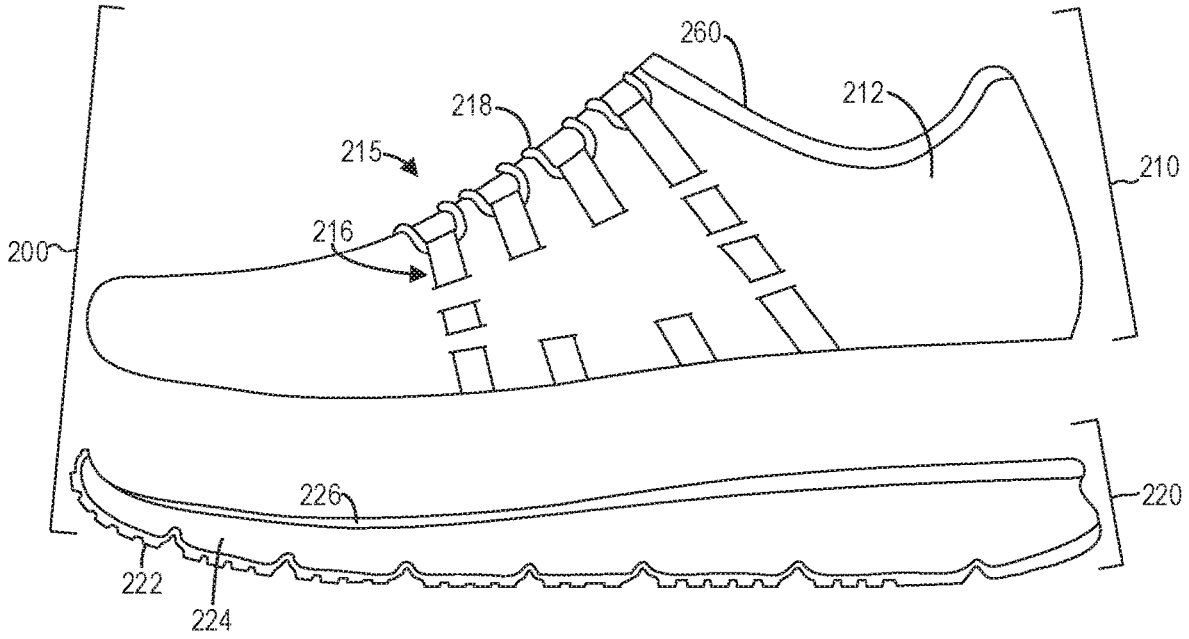
FIG. 2 shows an exploded view of the article of footwear of FIG. 1.
Figure 8:
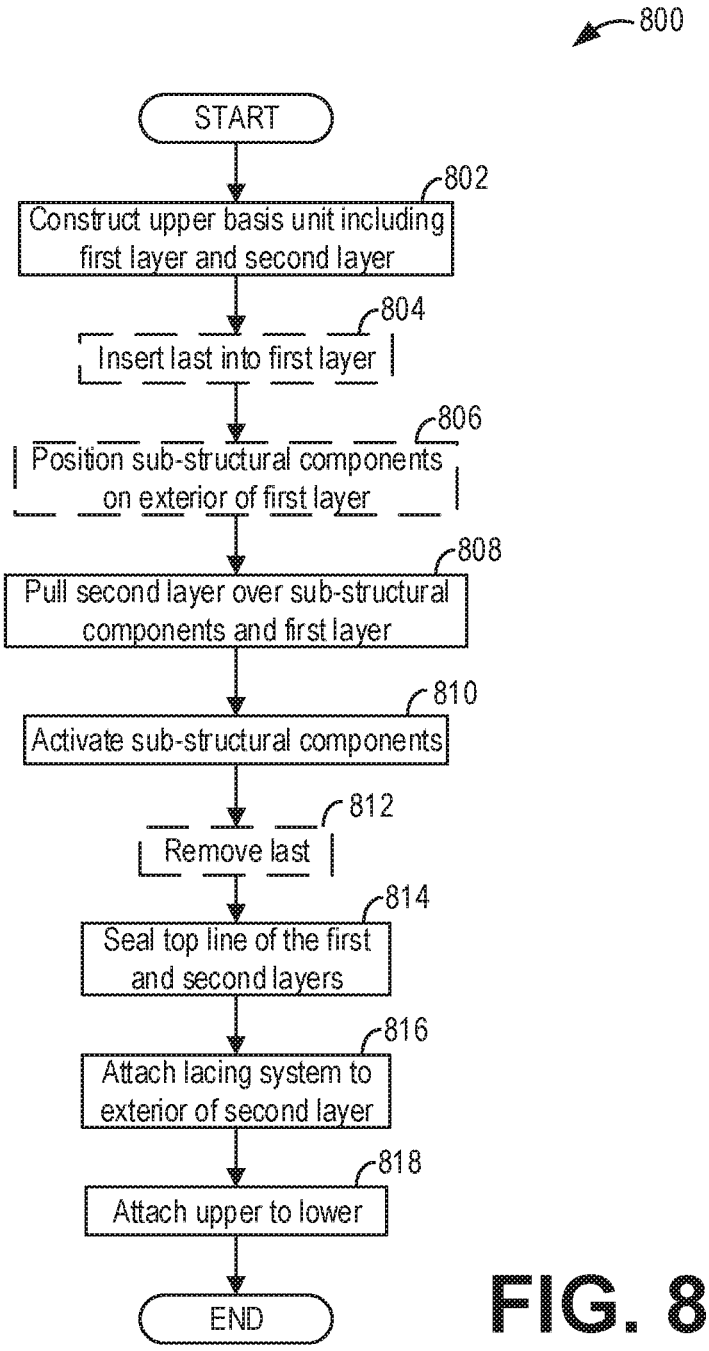
FIG. 8 shows a high-level flow chart illustrating an example method for manufacturing an article of footwear with a sock-like upper.
Figure 9:
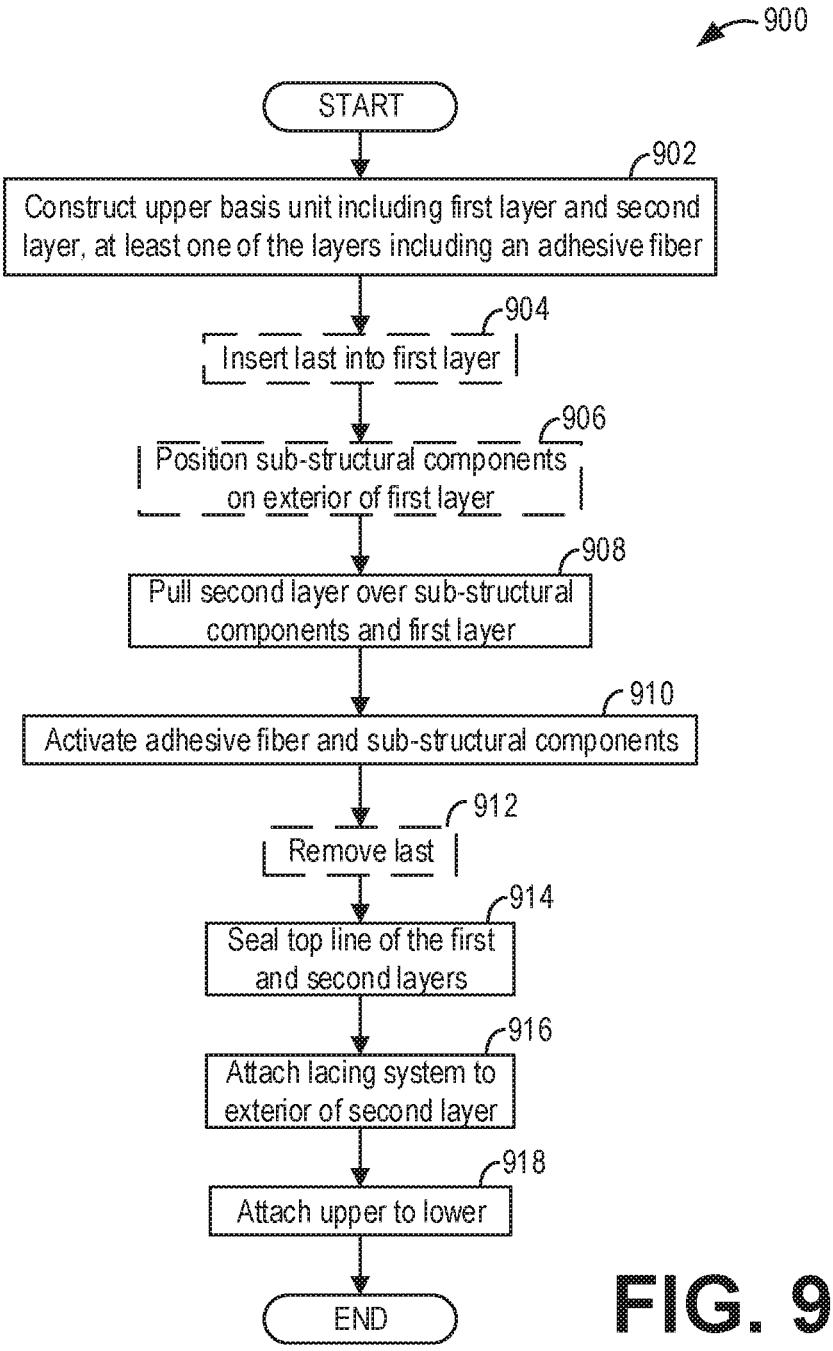
FIG. 9 shows a high-level flow chart illustrating an alternative example method for manufacturing an article of footwear with a sock-like upper.
Figure 10:
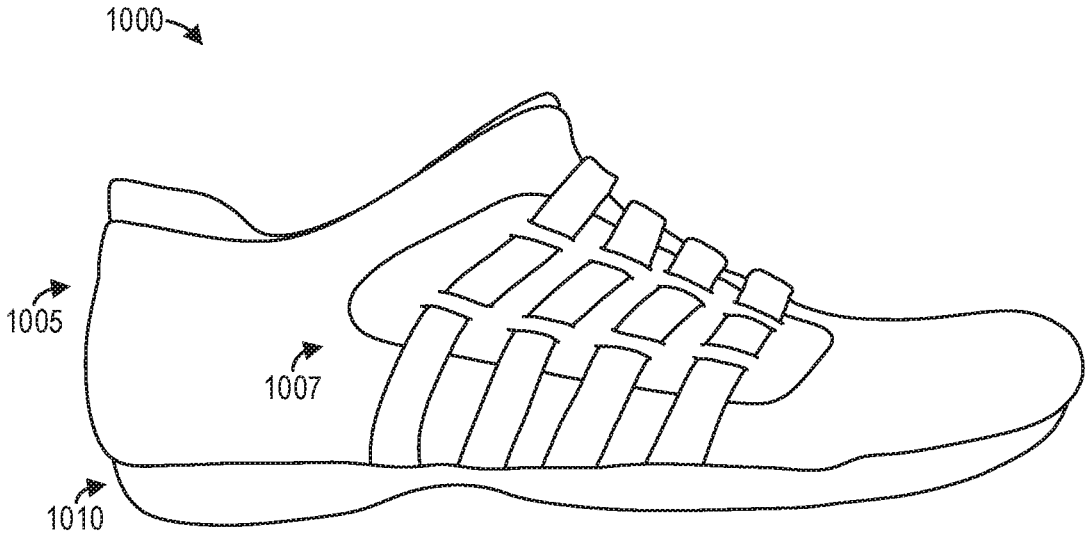
FIG. 10 shows a side view of a sock-like upper coupled to a lower.
Figure 11:
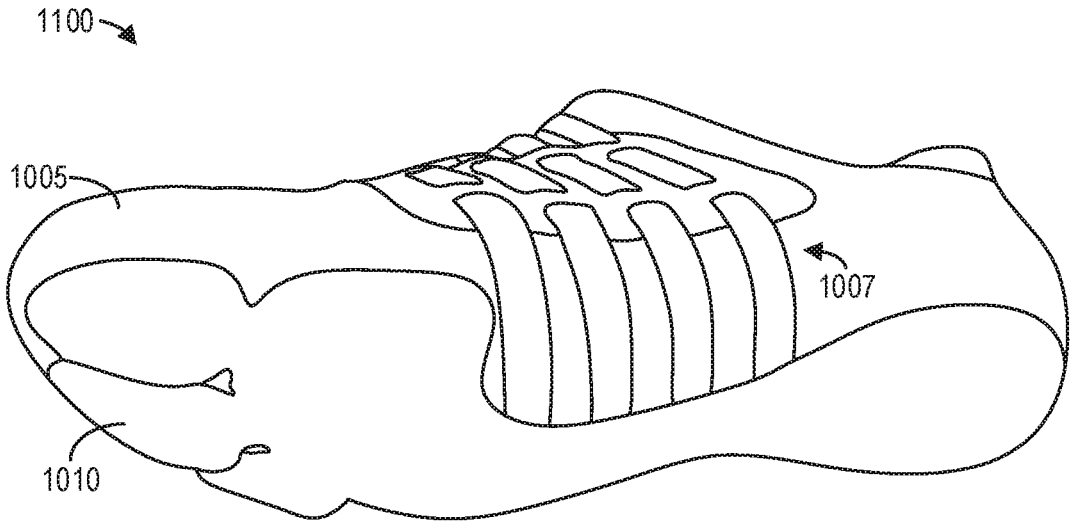
FIG. 11 shows a bottom perspective view of the sock-like upper coupled to the lower.

Articles of footwear having a sock-like upper and methods for manufacturing said articles of footwear are described herein. The sock-like upper includes two socks with structural components disposed therebetween. In this way, an upper may provide an improved fit and comfort when worn on a foot. In addition, the sock-like upper provides a seamless inner lining against the foot. As shown in FIGS. 1-2, an article of footwear in accordance with the disclosure may include a sock-like upper and a lower. The sock-like upper may be constructed from an upper basis unit, as shown in FIGS. 3-7. Methods for manufacturing articles of footwear including a sock-like upper are shown in FIGS. 8-9. Articles of footwear including a sock-like upper may further include a lower, as shown in FIGS. 10-11. FIGS. 12-15 show different configurations for interfaces between a first knitted layer (or sock) and a second knitted layer (or sock).

FIGS. 1-7 and 10-11 are drawn approximately to scale for a given sample size, however it should be understood that the articles of footwear and components thereof may be provided in a variety of sizes, from child to adult. Regarding terminology, the term "sock" as used herein refers to a garment worn on a foot and knitted from a material such as cotton, wool, nylon, and/or other fibers.

Turning now to the figures, FIG. 1 shows an article of footwear 100 according to an embodiment of the disclosure. As shown, the article of footwear 100 includes an upper 110 and a lower 120.

The upper 110 comprises an upper basis unit 112 which may include one or more sub-structural elements (not shown) positioned within the upper basis unit 112. As described further herein with regard to FIGS. 3 and 4, an upper basis unit 112 may comprise a sock-like material. The upper 110 includes a lacing system 115 comprising a plurality of straps 116. Each strap of the plurality of straps 116 includes a loop at each end of the strap. The lacing system 115 further comprises a lace 118 which may pass through each loop in the plurality of straps, thereby enabling the upper 110 to be tightened around a foot inserted into the upper 110. The article of footwear 100 includes an overlay 114 attached to the exterior of the upper basis unit 112. The plurality of straps may be woven through the overlay 114, as depicted.

The lower 120 may comprise one or more layers. In one example, the lower 120 may comprise an outsole 122 and a midsole 124, where the outsole 122 is attached to the bottom of the molded midsole 124. The lower 120 may further comprise an insole 126 which may be in contact with a bottom surface of the upper 110. In another example, the lower 120 may comprise a single molded piece.

In some examples, the lower 120 may be injection molded from foams made from ethylene-vinyl-acetate, or a combination of rubber and ethylene-vinyl-acetate, or polyurethane. These plastics are merely representative and other tough but lightweight and flexible plastic materials can be used, if desired. One advantage of using these lightweight plastic materials is that the lower may be formed inexpensively. An additional advantage is that the lower 120 may be directly injected to the upper, for example via direct soling.

FIG. 2 shows an exploded view of an article of footwear 200 in accordance with an embodiment of the disclosure. The article of footwear 200 may be substantially the same as the article of footwear 100 depicted in FIG. 1. For example, the article of footwear 200 includes an upper 210 and a lower 220, separately depicted.

The upper 210 comprises an upper basis unit 212 which may include one or more sub-structural components (not shown) therein. The upper 210 further includes a lacing system 215 comprising a plurality of straps 216 and a lace 218 laced through loops in the end of the plurality of straps 216, as described above with regard to the lacing system 115 in FIG. 1. However, in some examples, the article of footwear 200 may not include an overlay on the exterior of the upper basis unit 212, and so the plurality of straps 216 may be woven directly into the upper basis unit 212 as depicted.

The lower 220 may include an outsole 222, a midsole 224, and an insole 226. In some examples, one or more of the outsole 222, midsole 224, and insole 226 may be separately manufactured and then assembled to form the lower 220. However, in some examples, one or more of the outsole 222, the midsole 224, and the insole 226 may be integrally molded to form a single component.

As described further herein, the upper basis unit 212 may comprise at least two knitted layers attached to each other at a connection point. For example, the two knitted layers may comprise two socks stitched together at the toe. One or more sub-structural components may be placed on a first sock, and the second sock may then be pulled over the first sock and the sub-structural components. The top lines of each sock may then be stitched together to form a single top line 260 so that no additional matter may be inserted in between the two socks, or layers.

Figure 3:
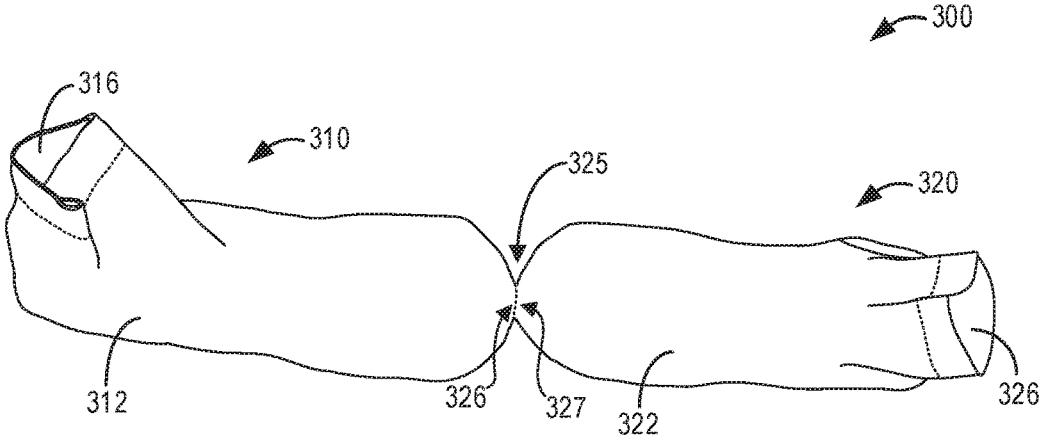
FIG. 3 shows an upper basis unit.

FIG. 3 shows an upper basis unit 300 according to an embodiment of the disclosure. The upper basis unit 300 comprises a singular unit. In one example, the singular unit 300 may comprise a single knitted sleeve. For example, the upper basis unit 300 depicted may be knitted as an individual unit. In another example, the upper basis unit 300 may comprise two individually knitted units sewn together at one end 325. For example, the upper basis unit 300 may comprise two individually knitted socks sewn together at the toe. The upper basis unit 300 may be manufactured, for example, with a circular knit machine.

The upper basis unit 300 includes a first layer 310 and a second layer 320, the two layers connected to each other at an end 325 of each layer as shown. In particular, the first layer 310 may include a first connection point 326 while the second layer 320 may include a second connection point 327, and the layers may be connected at the connection points to form an interface 325. The connection points 326 and 327 may be positioned at a same location for each of the layers. For example, using common terminology for a sock and wherein each layer may be considered an individual sock, the connection points may be located at the toe of each sock, so that the toes of the socks are connected. This is in contrast to the connection points 326 and 327 being located at any other location. For example, a connection point at a heel of the first sock connected to a connection point at a toe of the second sock would not function in accordance with the current disclosure.

In some examples, both the first layer 310 and the second layer 320 may be substantially the same size. However, in other examples, one of the layers may be larger than the other layer. For example, since the second layer 320 may be pulled over the first layer 310, the second layer 320 may be larger than the first layer 310 in order to accommodate sub-structural components placed on the first layer 310. Furthermore, in some examples the first layer 310 and the second layer 320 may be identical. However, in other examples the first layer 310 and the second layer 320 may have particular differences. For example, in some examples the first layer 310 may include pre-structural elements integrated therein, such as a reinforced toe, which the second layer 320 may not include. Similarly, the second layer 320 may include pre-structural elements integrated therein which the first layer 310 may not include. For example, the second layer 320 may include a plurality of slits included therein through which a plurality of straps may be woven, as described further herein below.

Each of the layers 310 and 320 includes an interior and an exterior. In particular, the first layer 310 may include an interior 316 and an exterior 312, while the second layer 320 may include an interior 322 and an exterior 326. As depicted, the interior 322 and the exterior 326 may appear inverted in comparison to the exterior 312 and the interior 316. This inversion occurs because the second layer 320 may be pulled over the first layer 310 such that the interior 322 of the second layer 320 is in contact with the exterior 312 and the exterior 326 of the second layer 320 functions as the exterior of the entire upper basis unit 300. Meanwhile, the interior 316 of the first layer 310 may be in contact with a foot inserted into an article of footwear comprising the upper basis unit 300, such as the article of footwear 100 depicted in FIG. 1. As discussed further herein below, a plurality of sub-structural elements may be inserted between the exterior 312 of the first layer 310 and the interior 322 of the second layer 320.

Figure 4:
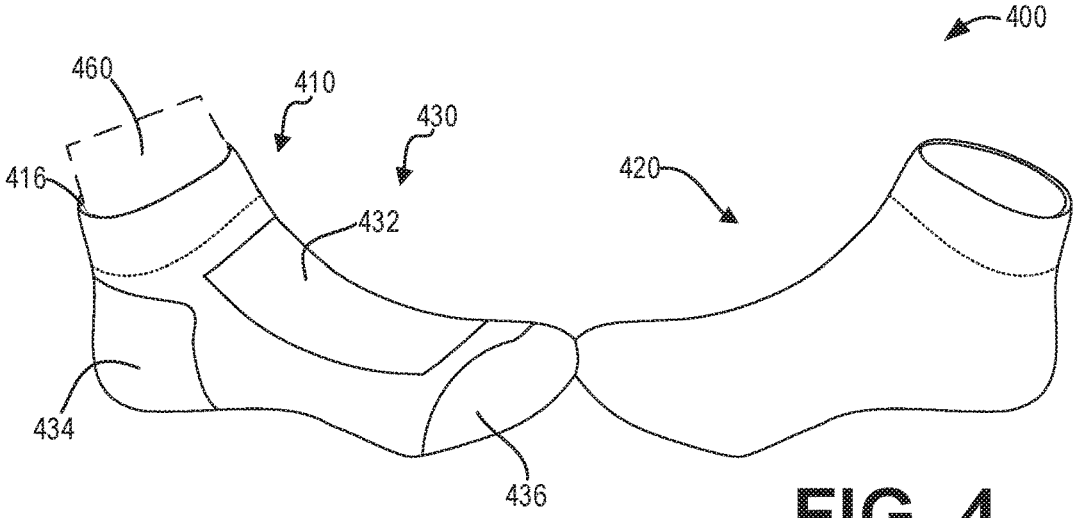
FIG. 4 shows the upper basis unit of FIG. 3 with sub-structural components thereon.

FIG. 4 shows an upper basis unit 400 with a plurality of sub-structural components 430 positioned thereon according to an embodiment of the disclosure. The upper basis unit 400 may comprise the upper basis unit 300 described herein above, and so may include a first layer 410 and a second layer 420. The plurality of sub-structural components 430 may be positioned on one of the layers, for example the first layer 410 as depicted. In some examples, one or more of the plurality of sub-structural components 430 may be positioned on the second layer 420 while the remaining sub-structural components of the plurality of sub-structural components 430 may be positioned on the first layer 410.

An optional last 460, comprising a physical model shaped like a foot, may be inserted into the first layer 410 in order to provide temporary three-dimensional structure to the first layer 410. The last 460 may be positioned within the first layer 410, such that the interior 416 is in contact with the last 460, while the article of footwear is constructed, and the last 460 may be removed at a suitable time prior to or after completion of the article of footwear.

The plurality of sub-structural components 430 may optionally include, as non-limiting examples, a tongue foam 432, a heel counter 434, and a toe box 436. The tongue foam 432 may comprise, for example, a porous foam which pads the instep of a foot from pressure provided thereto by a lacing system while simultaneously providing breathability. Thus, in one example, the tongue foam 432 may be positioned on the exterior of the first layer 410 at the instep of the first layer 410 as depicted. The heel counter 434 may comprise, for example, a plastic or composite material which stiffens and reinforces the heel area. Thus, in one example, the heel counter 434 may be positioned on the exterior of the first layer 410 at the heel of the first layer 410 as depicted. The toe box 436 may comprise one or more materials providing protection for the toes of a foot. Thus, in one example, the toe box 436 may be positioned on the exterior of the first layer 410 at the toes of the first layer 410 as depicted. While a plurality of sub-structural components 430 is described, in some examples, only a single sub-structural component may be attached to the exterior of the first layer 410.

In some examples, one or more of the plurality of sub-structural components 430 may be fixedly attached to the first layer 410 in order to secure the position of the sub-structural components. For example, after positioning the plurality of sub-structural components 430 on the first layer 410, the second layer 420 may be pulled over the plurality of sub-structural components 430 and the first layer 410 such that the second layer 420 envelopes the plurality of sub-structural components 430 and the first layer 410.

After pulling the second layer 420 over the first layer 410 and the plurality of sub-structural components 430, the sub-structural components 430 may be activated via heat or other activation methods to harden the sub-structural components 430 and thereby couple the first 410 and second 420 layers. As a result, a sock-like upper with a firm three-dimensional structure is created from the relatively flat and unstructured upper basis unit 300.

Further, one or more of the plurality of sub-structural components 430 may include an adhesive material which coats the exterior and/or interior of the sub-structural component, such that activating the sub-structural components with heat causes the adhesive material, and thus the sub-structural components, to adhere to the first layer 410 and/or the second layer 420.

In another embodiment, the sub-structural components may not include an adhesive coating which adheres the sub-structural components to the first and second layers. Instead, adhesive fibers may be integrated into the first and/or second layers. Such an embodiment is described herein below with regard to FIG. 5.

Figure 5:
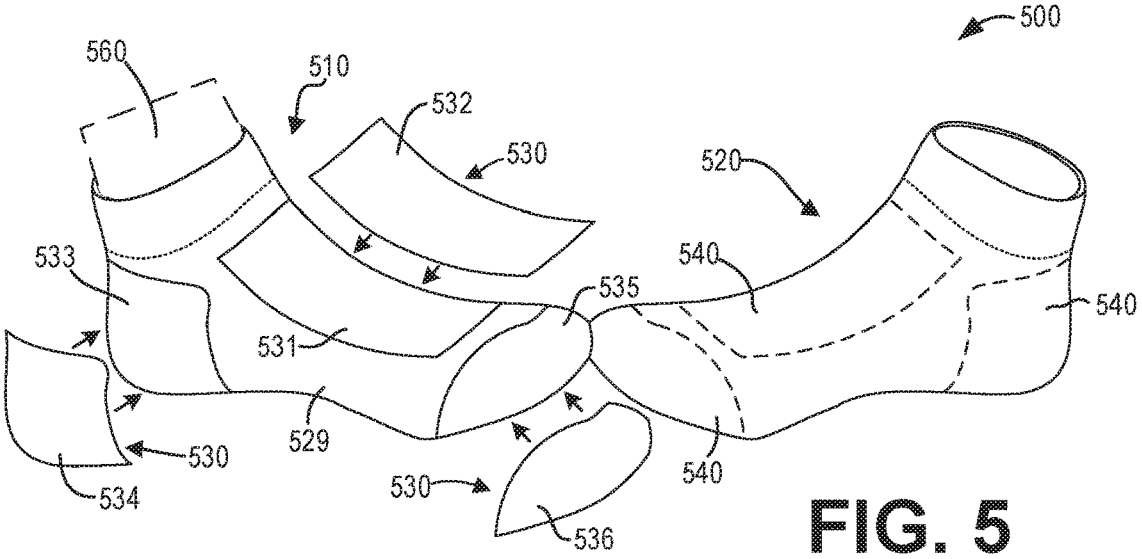
FIG. 5 shows the upper basis unit of FIG. 3 with adhesive fibers integrated therein.

FIG. 5 shows an upper basis unit 500 with a plurality of sub-structural components 530 according to an embodiment of the disclosure. The upper basis unit 500 may comprise the upper basis unit 300 described herein above, and so may include a first layer 510 and a second layer 520.

The first layer 510 may include one or more regions such as regions 531, 533, and 535 wherein adhesive fibers are integrated therein. As a non-limiting example, the first layer 510 may be knitted at least partially from a hot-melt adhesive fiber, the adhesive properties of which may be activated via heat. By incorporating hot-melt adhesive fiber into the construction of the upper basis unit 500, it may be possible to permanently couple the first layer 510 to one or more sub-structural components 530 as well as the second layer 520.

In some embodiments comprising a partial hot-melt fiber construction, the hot-melt fiber may be knitted into a first layer 510 in an alternating manner wherein the hot-melt fiber may be present in every second stitch, every third stitch, every fourth stitch, and so on. More specifically, the first layer 510 may be knitted such that every other stitch or every second stitch comprises hot-melt fiber. In other examples, the knitting of the first layer 510 may include hot-melt fiber in every third stitch.

For example, in embodiments comprising at least a partial hot-melt fiber knit construction, the knitting may comprise at least a section of fiber comprising a heat-induced adhesive property, such as regions 531, 533, and 535, in addition to a region 529 comprising fiber that does not have a heat-induced adhesive property such as cotton, wool, nylon, and/or other fibers that may be suitable for footwear applications.

Further, in some examples the second layer 520 may include one or more regions 540 comprising at least a partial hot-melt fiber knit construction as described herein above with regard to the first layer 510. The adhesive regions 540 may similarly correspond to the positions of the plurality of sub-structural components 530.

The plurality of sub-structural components 530 may be positioned on one of the layers, for example the first layer 510 as depicted with an exploded view. In some examples, one or more of the plurality of sub-structural components 530 may be positioned on the second layer 520 while the remaining sub-structural components of the plurality of sub-structural components 530 may be positioned on the first layer 510.

Thus, in some example embodiments, the first layer 510 may comprise a partial hot-melt fiber construction. In providing a partial hot-melt fiber construction, it may be possible to provide a first layer 510 that may be fixedly coupled to a plurality of sub-structural components 530 and a second layer 520 without affecting the overall comfort of the footwear component. In this way, additional stitching or sewing steps may be eliminated from the manufacturing process such that the two layers of the footwear upper may be joined solely from heat application.

In particular embodiments, a hot-melt or otherwise adhesive fiber may be incorporated into only specific regions of the first layer 510. For example, a region 531 may correspond to the desired placement of a tongue foam 532. Similarly, a region 533 including adhesive fiber may correspond to the desired placement of a heel counter 534. Further still, a region 535 including adhesive fiber may correspond to the desired placement of a toe counter 536. The aforementioned sub-structural components 530 may thus be positioned on the corresponding adhesive regions prior to pulling the second layer 520 over the sub-structural components 530 and the first layer 510 as described herein above.

By using an alternating stitching including non-adhesive fibers and adhesive fibers, the two layers of the footwear upper may be permanently coupled to each other via heat application while still allowing airflow to permeate each layer, thereby enabling ventilation and ensuring comfort while worn.

While the adhesive regions 531, 533, and 535 are depicted and described as fully integrating the adhesive fibers into the first layer 510, some embodiments may include a partial hot-melt fiber knit pattern such that hot-melt fiber may be incorporated along the peripheral edges of sub-structural components 530 such as a toe box 536 and/or a heel counter 534 of a first layer 510 of the footwear upper. Alternatively, hot-melt fiber may be integrated throughout the first layer 510. In other words, the entirety of the first layer 510 may include at least a partial hot-melt fiber knit construction wherein hot-melt fiber comprises every second stitch, every third stitch, or similar knit patterns that may be possible via a circular knitting process. As a further alternative, hot-melt fiber may be integrated via alternating stitching into at least a portion of both the first layer 510 and the second layer 520.

After pulling the second layer 520 over the first layer 510 and the plurality of sub-structural components 530, the sub-structural components 530 as well as the hot-melt fiber incorporated into the first layer's construction may be activated via heat or other activation methods to harden the sub-structural components 530 and/or melt the hot-melt fiber, thereby permanently coupling the first layer 510 to the sub-structural components 530. In examples wherein the adhesive regions extend beyond the relative positions of the sub-structural components 530, activating the hot-melt fiber may adhere the first layer 510 to the second layer 520. As a result, a sock-like upper with a firm three-dimensional structure is created from the relatively flat and unstructured upper basis unit 300.

In embodiments comprising at least a partial hot-melt fiber construction, the two layers 510, 520 may be joined without supplemental stitching or sewing. In this way, additional stitching or sewing steps may be eliminated from the manufacturing process such that the two layers of the footwear upper may be joined by the adhesive properties of the hot-melt fiber responsive to heat application.

In some examples, the first layer 510 (and optionally, the second layer 520) may include adhesive regions (not pictured) which extend through the non-adhesive region 529 and between one or more of the adhesive regions 531, 533, and 535. These adhesive regions may further extend to the top line of the first layer 510.

In an alternative embodiment, the adhesive and non-adhesive regions may be switched from the embodiment described herein above. That is, region 529 may comprise an adhesive region, while regions 531, 533, and 535 may comprise non-adhesive regions. In this way, the adhesive region 529 will adhere to the second layer 520 but not to the sub-structural components 530, thereby creating bonded pockets around the sub-structural components. Similarly, regions 540 of the second layer 520 may comprise optional non-adhesive regions while the remainder of the second layer 520 may comprise an optional adhesive region. In this way, the bonding of the adhesive region 529 of the first layer 510 to the adhesive region of the second layer 520 may be stronger.

Figure 6:
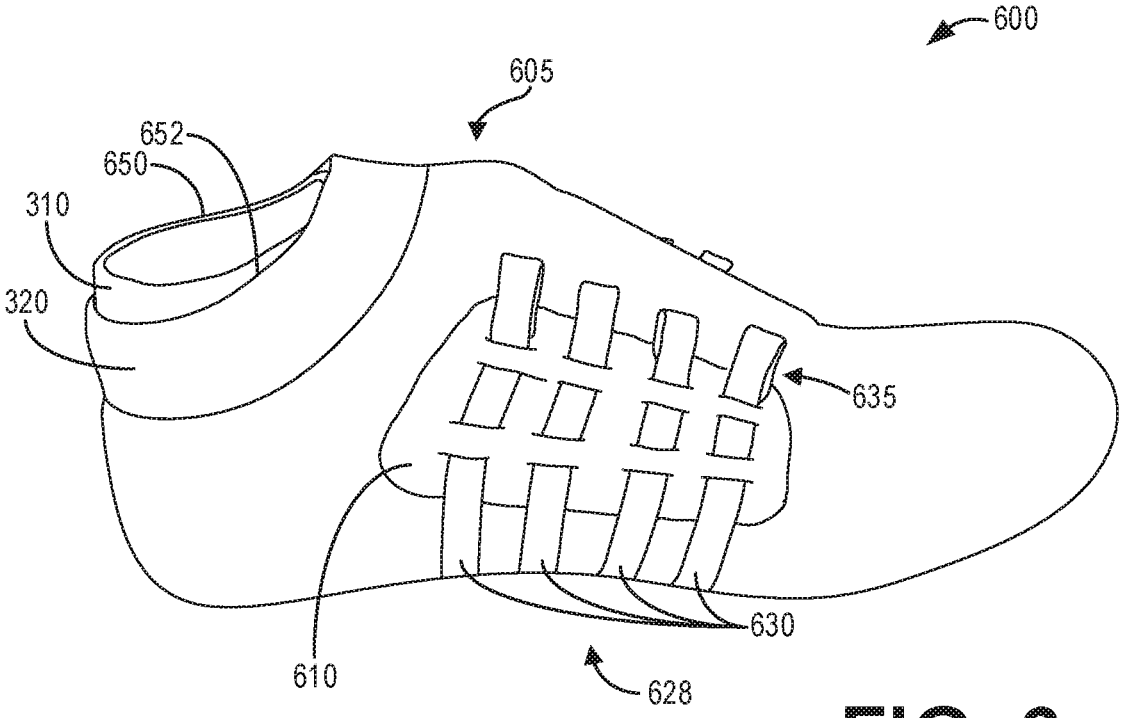
FIG. 6 shows a sock-like upper.
Figure 7:
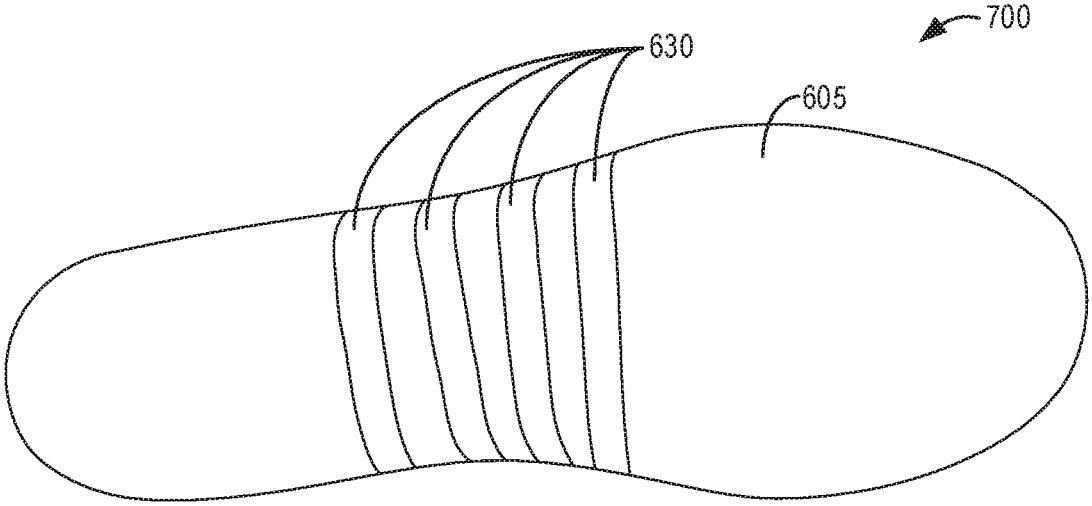
FIG. 7 shows a bottom plane view of the sock-like upper of FIG. 5.

FIG. 6 shows a sock-like upper 600 comprising an upper basis unit 605 with a lacing system 628 attached thereto. Note that the upper basis unit 605 includes a first layer 310 and a second layer 320, as described herein above with regard to FIGS. 3-5. The upper basis unit 605 may include a plurality of sub-structural components therein as described herein above, which may be activated prior to attaching the lacing system 628.

One or more overlays 610 may be attached to the exterior of the upper basis unit 605. In particular, the one or more overlays 610 may be positioned on the exterior of the upper basis unit 605 so as to cover at least a portion of the instep on one or more sides of the upper basis unit 605. The overlays 610 may comprise any suitable material, such as leather, canvas, synthetic polymers, and so on. The lacing system 628 includes a plurality of straps 630, wherein each strap of the plurality of straps 630 includes a loop 635 at each end. The plurality of straps 630 may wrap around a bottom of the upper basis unit 605, for example as depicted in the bottom view 700 of the sock-like upper in FIG. 7, such that the ends of the plurality of straps 630 may be positioned on each side of a longitudinal axis of the sock-like upper 600. In this way, a lace (not shown) may be laced through each of the loops 635 on both sides of the sock-like upper 600 to complete the lacing system 628.

Furthermore, the plurality of straps 630 may be woven through the overlay 610, as depicted. In some examples, the sock-like upper 600 may not include an overlay 610. In such examples, the plurality of straps 630 may be directly woven into the upper basis unit 605. In other examples, the sock-like upper 600 may include one or more overlays 610 which are not positioned halfway along a longitudinal axis of the sock-like upper 600, and the plurality of straps 630 may be woven directly into the upper basis unit 605.

While first layer 310 and second layer 320 are visible in FIG. 6, the top line 650 of the first layer 310 and the top line 652 of the second layer 320 may be stitched or adhesively sealed, thereby forming a single top line (such as, for example, the single top line 260 depicted in FIGS. 1-2). In this way, no additional material may be inserted in between the first layer 310 and the second layer 320.

FIG. 8 shows a high-level flow chart illustrating an example method 800 for manufacturing articles of footwear with a sock-like upper, such as the articles of footwear 100 and 200 depicted in FIGS. 1-2.

Method 800 begins at 802. At 802, method 800 may include constructing an upper basis unit including a first layer and a second layer. The first layer and the second layer are connected together at an end of each layer in order to form an integral unit. Each layer includes an exterior and an interior separated by a top line. The upper basis unit may be constructed, for example, using a circular knit machine. In one example, the upper basis unit may be constructed as a single sleeve. In another example, the upper basis unit may be constructed as two units (i.e., the first layer and the second layer) sewn together at the toe.

Continuing at 804, method 800 may optionally include inserting a last into the first layer. The last comprises a model shaped like a human foot over which an article of footwear is constructed, and in this way the last provides the shape of the article of footwear. By inserting the last into the first layer such that the interior of the first layer is in contact with the last, the first layer assumes the form of the last.

At 806, method 800 may optionally include positioning sub-structural components on the exterior of the first layer. Sub-structural components may comprise, for example, a toe box material, a heel counter, tongue foam, and so on.

At 808, method 800 may include pulling the second layer over the sub-structural components and the first layer. In one example, the second layer may be pulled towards the first layer such that the second layer turns inside out, where the exterior of the second layer is in contact with the sub-structural components and the exterior of the first layer. The interior of the second layer thus becomes the exterior of the upper.

At 810, method 800 may include activating the sub-structural components. Activating the sub-structural components may comprise applying heat to the sub-structural components. The sub-structural components may comprise a heat formable or a hot melt material such that when activated, the sub-structural components harden. In this way, the upper assumes a three-dimensional form.

At 812, method 800 may optionally include removing the last from the first layer. While removing the last is depicted as occurring after activating the sub-structural components, the last may be removed at any convenient point during the method 800. For example, the last may be removed prior to activating the sub-structural components 810. In other examples, the last may not be removed until after the construction of the article of footwear is complete.

Continuing at 814, method 800 may include sealing a top line of the first and second layers. Sealing the top line of both layers may comprise, for example, stitching the top lines of the layers together. As another example, sealing the top line may comprise applying heat bonding adhesive to the top line, and heating the heat bonding adhesive to seal the top line of the layers together. By sealing the top lines of the first and second layers, no additional material may be inserted in between the first and the second layers.

At 816, method 800 may include attaching a lacing system to the exterior of the second layer. The lacing system may include a plurality of straps wrapped around the second layer, wherein each of the straps includes a loop at each end. The plurality of straps may be woven through an overlay or through openings in the second layer. A lace may be laced through each loop. Once the lacing system is attached to the exterior of the second layer, the combination of the lacing system, the sub-structural components, and the first and second layers comprises a sock-like upper.

At 818, method 800 may include attaching the sock-like upper to a lower. In one example, the lower may be directly injected or directly molded to the upper. In another example, the lower may be separately constructed, for example using injection molding, and then attached to the upper. In some examples, the lower may be attached to the upper via the plurality of straps which pass along the bottom of the upper. Additionally or alternatively, an adhesive may be used to fix the separately-constructed lower to the upper.

As an illustrative example, FIGS. 10-11 show different views of a sock-like upper coupled to a lower. In particular, FIG. 10 shows a side view 1000 of an article of footwear comprising an upper 1005 and a lower 1010, while FIG. 11 shows a bottom perspective view 1100 of the article of footwear depicted in FIG. 10. As shown, the upper 1005 may include a lacing system 1007 comprising a plurality of straps laced through an overlay and wrapping around the upper 1005. In some examples, the lower 1010 depicted in FIGS. 10-11 may comprise a midsole, and the lower of the article of footwear may further include an outsole (not depicted) attached to and/or encapsulating the midsole 1010.

After attaching the sock-like upper to the lower, method 800 may then end.

While method 800 is described above in a specific order, it should be appreciated that in some examples, one or more of the actions of method 800 may be carried out in a different order. For example, in some examples, action 808 may occur prior to action 806. For example, the second layer may be pulled over the first layer prior to positioning the sub-structural components on the exterior of the first layer. In such examples, positioning the sub-structural components on the exterior of the first layer may comprise inserting the sub-structural components in between the first layer and the second layer and positioning the components in their respectively intended positions between the layers. As another example, sealing the top line of the layers may occur prior to activating the sub-structural components and the hot-melt fiber. For example, if sealing the top line comprises applying a heat-bonding adhesive, the heat-bonding adhesive may be applied to the top line prior to activating the sub-structural components so that the heat bonding adhesive may be activated simultaneously with the sub-structural components. However, in some examples where sealing the top line comprises applying a heat bonding adhesive, the heat bonding adhesive may not occur prior to activating the sub-structural components or may be separately activated.

In particular embodiments wherein the first layer 310 comprises at least a partial hot-melt fiber knit construction, sealing the top line of the layers may comprise applying heat to a hot-melt fiber that may be incorporated into the knitting of the first layer 310. In this way, the two layers of the footwear upper may be effectively coupled to one another forming a single, unitary footwear component.

FIG. 9 shows a high-level flow chart illustrating an example method 900 for manufacturing articles of footwear with a sock-like upper, such as the articles of footwear 100 and 200 depicted in FIGS. 1-2. In contrast with the method 800 described herein above with regard to FIG. 8, method 900 may be utilized in embodiments including adhesive fiber as described herein above with regard to FIG. 5.

Method 900 begins at 902. At 902, method 900 may include constructing an upper basis unit including a first layer and a second layer. The first layer and the second layer are connected together at an end of each layer in order to form an integral unit. Each layer includes an exterior and an interior separated by a top line. The upper basis unit may be constructed, for example, using a circular knit machine. In one example, the upper basis unit may be constructed as a single sleeve. In another example, the upper basis unit may be constructed as two units (i.e., the first layer and the second layer) sewn together at the toe.

As described herein above with regard to FIG. 5, an adhesive fiber such as a hot-melt fiber may be integrated into at least one of the layers. For example, the first layer may include one or more regions wherein the adhesive fiber is alternately stitched with a non-adhesive fiber. In particular, the adhesive fiber may comprise every other stitch, every second stitch, every third stitch, or every fourth stitch, and so on, in at least one region of the first layer, thereby creating an adhesive region or regions. These adhesive regions may, in some examples, correspond to the desired positions of one or more sub-structural components.

Continuing at 904, method 900 may optionally include inserting a last into the first layer. The last comprises a model shaped like a human foot over which an article of footwear is constructed, and in this way the last provides the shape of the article of footwear. By inserting the last into the first layer such that the interior of the first layer is in contact with the last, the first layer assumes the form of the last.

At 906, method 900 may include positioning sub-structural components on the exterior of the first layer. Sub-structural components may comprise, for example, a toe box material, a heel counter, tongue foam, and so on. The sub-structural components may be positioned at adhesive regions of the exterior of the first layer.

At 908, method 900 may include pulling the second layer over the sub-structural components and the first layer. In one example, the second layer may be pulled towards the first layer such that the second layer turns inside out, where the exterior of the second layer is in contact with the sub-structural components and the exterior of the first layer. The interior of the second layer thus becomes the exterior of the upper.

At 910, method 900 may include activating the sub-structural components and the adhesive fiber included in the knitting pattern of the first layer. Activating the sub-structural components and the adhesive fiber may comprise applying heat to the sub-structural components and the first layer. The sub-structural components may comprise a heat-formable material such that when activated, the sub-structural components harden. In this way, the upper assumes a three-dimensional form. Further, the adhesive fiber may be activated via applying heat to the first layer such that when activated, the adhesive properties of the adhesive fiber activate, thereby adhering the first layer to at least the sub-structural components, and in examples wherein the adhesive fiber is integrated throughout the first layer, to the second layer. In this way, the first layer, second layer, and sub-structural components may be permanently coupled, thereby creating a single, unitary footwear component.

At 912, method 900 may optionally include removing the last from the first layer. While removing the last is depicted as occurring after activating the sub-structural components and the adhesive fiber, the last may be removed at any convenient point during the method 900. For example, the last may be removed prior to activating the sub-structural components and adhesive fiber at 910. In other examples, the last may not be removed until after the construction of the article of footwear is complete.

Continuing at 914, method 900 may include sealing a top line of the first and second layers. Sealing the top line of both layers may comprise, for example, stitching the top lines of the layers together. As another example, the top line may include the adhesive fiber described above such that sealing the top line may comprise applying heat to the top line to seal the top line of the layers together. To that end, sealing the top line at 914 may occur at 910. By sealing the top lines of the first and second layers, no additional material may be inserted in between the first and the second layers.

At 916, method 900 may include attaching a lacing system to the exterior of the second layer. The lacing system may include a plurality of straps wrapped around the second layer, wherein each of the straps includes a loop at each end. The plurality of straps may be woven through an overlay or through openings in the second layer. A lace may be laced through each loop. Once the lacing system is attached to the exterior of the second layer, the combination of the lacing system, the sub-structural components, and the first and second layers comprises a sock-like upper.

At 918, method 900 may include attaching the sock-like upper to a lower. In one example, the lower may be directly injected or directly molded to the upper. In another example, the lower may be separately constructed, for example using injection molding, and then attached to the upper. In some examples, the lower may be attached to the upper via the plurality of straps which pass along the bottom of the upper. Additionally or alternatively, an adhesive may be used to fix the separately-constructed lower to the upper.

After attaching the sock-like upper to the lower, method 900 may then end.

While method 900 is described above in a specific order, it should be appreciated that in some examples, one or more of the actions of method 900 may be carried out in a different order. For example, in some examples, action 908 may occur prior to action 906. For example, the second layer may be pulled over the first layer prior to positioning the sub-structural components on the exterior of the first layer. In such examples, positioning the sub-structural components on the exterior of the first layer may comprise inserting the sub-structural components in between the first layer and the second layer and positioning the components in their respectively intended positions between the layers. As another example, sealing the top line of the layers may occur prior to activating the sub-structural components and the adhesive fiber. For example, if sealing the top line comprises applying a heat bonding adhesive, the heat bonding adhesive may be applied to the top line prior to activating the sub-structural components so that the heat bonding adhesive may be activated simultaneously with the sub-structural components. However, in some examples where sealing the top line comprises applying a heat bonding adhesive, the heat bonding adhesive may not occur prior to activating the sub-structural components or may be separately activated.

In particular embodiments wherein the first layer comprises at least a partial hot-melt fiber knit construction, sealing the top line of the layers may comprise applying heat to a hot-melt fiber that may be incorporated into the knitting of the first layer. In this way, the two layers of the footwear upper may be effectively coupled to one another forming a single, unitary footwear component.

Figure 12:
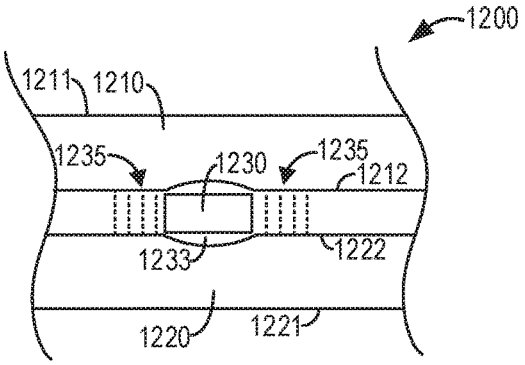
FIG. 12 shows an example configuration for containing a sub-structural component within a sock-like upper.

As discussed herein above with regard to FIG. 5, in some examples the adhesive fibers may be integrated into one or more of the first and second layers in order to create a pocket to hold a sub-structural component. FIG. 12 shows an example configuration 1200 wherein a first layer 1210 is bonded to a second layer 1220 such that a pocket 1233 is formed to hold a sub-structural component 1230. Specifically, the first layer 1210 and/or the second layer 1220 include adhesive fibers in selective regions such that the first layer 1210 and the second layer 1220 are bonded in a region 1235 surrounding the sub-structural component 1230. As depicted, neither of the layers are directly bonded to the sub-structural component 1230.

The first layer 1210 includes a first interior surface 1211 and a first exterior surface 1212, while the second layer 1220 includes a second interior surface 1222 and a second exterior surface 1221. As depicted, the first exterior surface 1212 is bonded to the second interior surface 1222 in the bonding region 1235 (depicted by the dashed lines) to form the pocket 1233.

It should be appreciated that the configuration 1200 is not drawn to scale, but instead comprises a schematic drawing which illustrates the bonding of the first exterior surface 1212 to the second interior surface 1222. That is, the space between the first exterior surface 1212 and the second interior surface 1222 is shown for schematic purposes, and in practice the first exterior surface 1212 is in face-sharing contact with the second interior surface 1222. The surfaces 1212 and 1222 are bonded to each other in the bonding region 1235, but are not bonded to each other outside of the region 1235 (depicted as empty space in FIG. 12). Further, the pocket 1233 may conform to the shape of the sub-structural component 1230, which though depicted as a box may comprise any suitable shape corresponding to a given sub-structural component.

Figure 13:
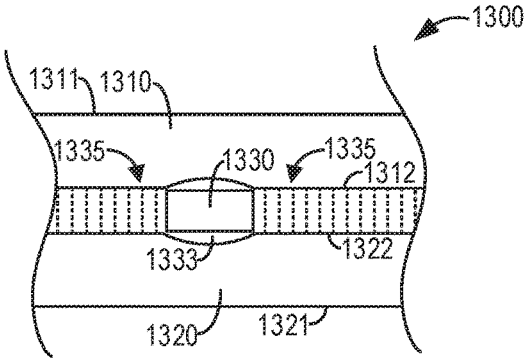
FIG. 13 shows another example configuration for containing a sub-structural component within a sock-like upper.

FIG. 13 shows another example configuration 1300 wherein a first layer 1310 is bonded to a second layer 1320 such that a pocket 1333 is formed to hold a sub-structural component 1330. In contrast with the example configuration 1200 depicted in FIG. 12, the first layer 1310, which includes a first interior surface 1311 and a first exterior surface 1312, is bonded to the second layer 1320, which includes a second interior surface 1322 and a second exterior surface 1321, in a bonding region 1335 which extends throughout the layers aside from the regions wherein a sub-structural component 1330 may be positioned. As depicted, the first exterior 1312 is bonded to the second interior 1322 in the bonding region 1335.

As discussed above with regard to FIG. 12, the configuration 1300 is not drawn to scale but instead comprises a schematic drawing of the interface between the layers. Specifically, the distance between the first exterior surface 1312 and the second interior surface 1322 may be minimal, as the two surfaces may, in practice, be in face-sharing contact with each other. Further, the pocket 1333 is depicted as including space between the first exterior surface 1312 and the second interior surface 1322 in order to illustrate that the surfaces are not bonded to the sub-structural component. In practice, the first exterior surface 1312 and the second interior surface 1322 may actually be in direct contact with the sub-structural component 1330, such that the pocket 1333 conforms to the shape of the sub-structural component 1330.

Figure 14:
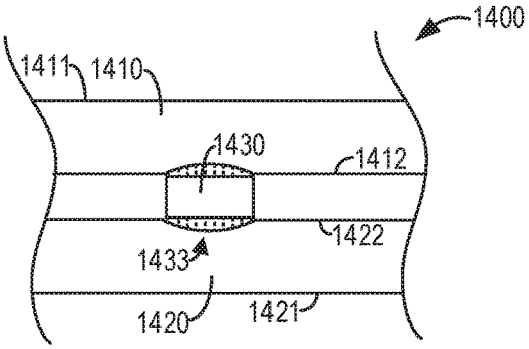
FIG. 14 shows yet another example configuration for containing a sub-structural component within a sock-like upper.

FIG. 14 shows an example configuration 1400 wherein a first layer 1410 and a second layer 1420 are bonded to a sub-structural component 1430. Specifically, the first exterior surface 1412 of the first layer 1410 is bonded to the sub-structural component 1430, while the second interior surface 1422 of the second layer 1420 is also bonded to the sub-structural component 1430. The first interior surface 1411 of the first layer 1410 and the second exterior surface 1421 of the second layer 1420 are not bonded. Though not depicted, in some examples, the bonding region 1433 may extend slightly beyond the sub-structural component between the layers.

Similar to the discussion herein above with regard to FIGS. 12-13, the configuration 1400 is not drawn to scale but instead comprises a schematic drawing which illustrates the bonding of the layers enabled by the adhesive fibers (not shown) integrated into the layers. That is, while the configuration 1400 depicts a gap between the first exterior surface 1412 and the second interior surface 1422, the two surfaces may, in practice, be in face-sharing contact with each other.

The example bonding configurations depicted in FIGS. 12-14, as described above, are non-limiting and illustrative examples of how a first knitted layer and a second knitted layer may be bonded to each other and/or a sub-structural component. In some examples, one or more of the bonding configurations described herein, as well as other configurations, may be utilized in a single upper. For example, one sub-structural component may be secured within an upper using the bonding configuration 1200, while another sub-structural component may be secured within the upper using the bonding configuration 1400.

Figure 15:
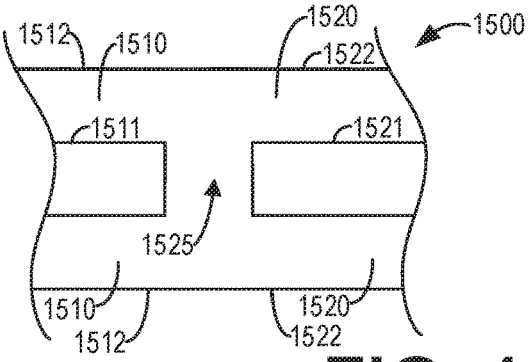
FIG. 15 shows a sock-like upper wherein a first layer and a second layer include a common connection point.

FIG. 15 shows an example configuration 1500 wherein a first layer 1510 and a second layer 1520 are knitted as a unitary piece such that a common connection point 1525 joins the two layers. The first layer 1510 includes a first interior surface 1511 and a first exterior surface 1512, while the second layer 1520 includes a second interior surface 1522 and a second exterior surface 1521. As discussed herein, when the second layer 1520 is folded back over the first layer 1510 at the connection point 1525, the second interior surface 1522 is in contact with the first exterior surface 1512.

The embodiments described herein allow for an improved fit and comfort to the upper through a simplified manufacturing process. The article of footwear, and specifically the sock-like upper, described herein "fits like a sock." It also allows a seamless inner lining against the foot.

There have been attempts at sock-like uppers but none have integrated the substructures between an inner and outer layer constructed as a single unit. Further, previous attempts relied upon flat knit and traditional shoemaking methods. The upper for an article of footwear described herein may be constructed on a circular knit machine.

The upper for an article of footwear described herein comprises a circular knitted shoe upper that is a singular unit that is either a single knitted sleeve or two units sewn together at the toe. The first layer is slipped over the last and becomes the liner while the second layer is slipped over the first to create the outer layer. In between the first and second layer would be inserted elements that comprise a toe box material, a heel counter, and tongue foam. These elements could be a heat formable or hot melt material that when activated give a three-dimensional form to the upper. The top line of the two socks (inner and outer layers) may then be closed via stitching or heat bonding adhesives. The last outer layer would integrate a lacing system that is woven through an overlay or openings in the outer sock for securing the foot to the sole unit.

Articles of footwear with a sock-like upper and methods for constructing such an article of footwear are disclosed. In one embodiment, an upper comprises: a first knitted layer including a first interior, a first exterior, and a first connection point; a second knitted layer including a second interior, a second exterior, and a second connection point, wherein the first knitted layer and the second knitted layer comprise a same material and are physically coupled at the first connection point and the second connection point to form an interface between the layers; and one or more sub-structural components positioned between the first exterior and the second interior, wherein the second knitted layer is pulled over the one or more sub-structural components and the first knitted layer to encompass the first exterior of the first knitted layer and the one or more sub-structural components.

In a first example of the upper, the upper further comprises an adhesive fiber integrated into at least a portion of the first knitted layer. In a second example of the upper optionally including the first example, the one or more sub-structural components are positioned at the portion of the first knitted layer including the adhesive fiber.

In a third example of the upper optionally including one or more of the first and second examples, the upper further comprises a plurality of straps positioned at the second exterior, and at least one lace coupled to each of the plurality of straps. The plurality of straps may be slidably movable with respect to the second exterior. In some examples, the plurality of straps may be fixed to the second exterior. In yet other examples, the plurality of straps may be partially fixed to the second exterior as well as slidably movable. In a fourth example of the upper optionally including one or more of the first through third examples, the upper further comprises a first overlay and a second overlay, the first overlay positioned on a medial side of the second exterior and the second overlay positioned on a lateral side of the second exterior, wherein the plurality of straps are woven through the first and second overlays. In a fifth example of the upper optionally including one or more of the first through fourth examples, the upper further comprises a plurality of bights, wherein each strap of the plurality of straps includes a bight at each end of the strap, and wherein the at least one lace is laced through the plurality of bights.

In a sixth example of the upper optionally including one or more of the first through fifth examples, the one or more sub-structural components includes one or more of a heel counter, a shape-retaining foam support, and a toe box.

In a seventh example of the upper optionally including one or more of the first through sixth examples, the first knitted layer further includes a first top line separating the first interior and the first exterior, and the second knitted layer further includes a second top line separating the second interior and the second exterior, wherein the first top line and the second top line are sealed together.

In another embodiment, a method for constructing an article of footwear comprises: constructing an upper basis unit comprising at least a first knitted layer and a second knitted layer, the first knitted layer coupled to the second knitted layer at a connection point located in a same location for each knitted layer; positioning at least one sub-structural component between the first knitted layer and the second knitted layer; activating the at least one sub-structural component; attaching a lacing system to an exterior of the upper basis unit; attaching a bottom face of the exterior of the upper basis unit to a lower, the lower including at least an outsole.

In a first example of the method, the method further comprises pulling the second knitted layer over the first knitted layer, wherein positioning the at least one sub-structural component between the first knitted layer and the second knitted layer comprises positioning the at least one sub-structural component on an exterior of the first knitted layer prior to pulling the second knitted layer over the first knitted layer.

In a second example of the method optionally including the first method, constructing the upper basis unit comprises knitting the first knitted layer and the second knitted layer with a circular knitting machine. In a third example of the method optionally including one or more of the first and second examples, the first knitted layer and the second knitted layer are knitted separately, and further comprising coupling the first knitted layer and the second knitted layer at the connection point. In a fourth example of the method optionally including one or more of the first through third examples, the first knitted layer and the second knitted layer are knitted as a single unit with the circular knitting machine.

In a fifth example of the method optionally including one or more of the first through fourth examples, activating the at least one sub-structural component comprises applying heat to the at least one sub-structural component.

In a sixth example of the method optionally including one or more of the first through fifth examples, attaching the lacing system comprises physically coupling a first overlay to a medial side of the exterior and physically coupling a second overlay to a lateral side of the exterior, wherein the plurality of straps are laced through openings in the first and second overlays.

In a seventh example of the method optionally including one or more of the first through sixth examples, the method further comprises physically coupling a top line of the first knitted layer to a top line of the second knitted layer.

In an eighth example of the method optionally including one or more of the first through seventh examples, the method further comprises knitting an adhesive fiber into at least a region of the first knitted layer with an alternating stitch, wherein the at least one sub-structural component is positioned at the region.

In a ninth example of the method optionally including one or more of the first through eighth examples, at least one of the first knitted layer and the second knitted layer includes adhesive fiber integrated therein, wherein activating the at least one sub-structural component further comprises applying heat to the at least one sub-structural component, wherein the heat further activates the adhesive fiber.

In yet another embodiment, an article of footwear comprises: an upper, the upper including a first knitted layer and a second knitted layer, the first knitted layer physically coupled to the second knitted layer and comprising a same shape as the second knitted layer; and a lower, the lower including a ground-contacting surface.

In a first example of the article of footwear, the first knitted layer and the second knitted layer are formed from a first material by a circular knitting machine. In a second example of the article of footwear optionally including the first example, the first knitted layer and the second knitted layer are separately formed and then joined at a closed end of each layer. In a third example of the article of footwear optionally including one or more of the first and second examples, the first knitted layer and the second knitted layer are formed in one piece.

In a fourth example of the article of footwear optionally including one or more of the first through third examples, the first knitted layer and the second knitted layer each include an interior and an exterior. In a fifth example of the article of footwear optionally including one or more of the first through fourth examples, the article of footwear further comprises a plurality of sub-structural components disposed between the exterior of the first knitted layer and the interior of the second knitted layer.

In a sixth example of the article of footwear optionally including one or more of the first through fifth examples, the first knitted layer and the second knitted layer are formed from a non-adhesive fiber, wherein at least one of the first knitted layer and the second knitted layer include an adhesive fiber alternately stitched with the non-adhesive fiber to form at least one adhesive region, and wherein the first knitted layer is physically coupled to the second knitted layer via the at least one adhesive region.

In a seventh example of the article of footwear optionally including one or more of the first through sixth examples, the first knitted layer further includes a first top line separating an interior and an exterior of the first knitted layer, and the second knitted layer further includes a second top line separating an interior and an exterior of the second knitted layer, wherein the first top line and the second top line are sealed together.

It will be appreciated that the configurations disclosed herein are exemplary in nature, and that these specific embodiments are not to be considered in a limiting sense, because numerous variations are possible. For example, the above technology can be applied to various types of footwear, such as boots and dress shoes. In another example, the technology can be applied to men's, women's, and children's footwear. Further, the technology can be applied to water-submersible shoes. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. An upper, comprising:

a first knitted layer including a first interior, a first exterior, and a first toe section;

a second knitted layer including a second interior, a second exterior, and a second toe section, wherein the first knitted layer and the second knitted layer comprise a same material and the first exterior of the first knitted layer and the second interior of the second knitted layer are physically coupled via a toe section attachment along at least a portion of the first toe section and the second toe section to form an interface between the first and second knitted layers, and wherein the toe section attachment does not extend along a remainder of the first exterior of the first knitted layer and the second interior of the second knitted layer; and one or more sub-structural components each having a first surface positioned adjacent to the first exterior of the first knitted layer, a second surface positioned adjacent to the second interior of the second knitted layer, and a peripheral edge extending between the second surface and the first surface, wherein each of the sub-structural components is positioned between the first exterior of the first knitted layer and the second interior of the second knitted layer, and wherein the one or more sub-structural components are constructed from a different material than the first knitted layer and the second knitted layer.

2. The upper of claim 1, further comprising an adhesive fiber integrated into at least a portion of the first knitted layer.

3. The upper of claim 2, wherein the one or more sub-structural components are positioned at the portion of the first knitted layer including the adhesive fiber.

4. The upper of claim 1, further comprising a plurality of straps positioned at the second exterior of the second knitted layer, and at least one lace coupled to each of the plurality of straps.

5. The upper of claim 4, further comprising an overlay, wherein the second exterior of the second knitted layer and the overlay are positioned on a lateral side of the second exterior of the second knitted layer, and wherein the plurality of straps is woven through the overlay.

6. The upper of claim 4, further comprising a plurality of bights, wherein each strap of the plurality of straps includes a bight at each end of the strap, and wherein the at least one lace is laced through the plurality of bights.

7. The upper of claim 1, wherein the one or more sub-structural components includes one or more of a heel counter positioned at a heel side of the upper, a toe box positioned on a toe side of the upper opposing the heel side, and a shape retaining foam support positioned between the heel side and the toe side of the upper.

8. The upper of claim 1, wherein the first knitted layer further includes a first top line separating the first interior and the first exterior of the first knitted layer, and the second knitted layer further includes a second top line separating the second interior and the second exterior of the second knitted layer, and wherein the first top line and the second top line are sealed together.

9. The upper of claim 5, where the overlay covers at least a portion of an instep of the upper.

10. The upper of claim 5, further comprising a plurality of straps woven through the overlay.

11. An upper, comprising:

a first knitted layer including a first interior, a first exterior, and a first toe section;

a second knitted layer distinct from the first knitted layer including a second interior, a second exterior, and a second toe section, wherein the first knitted layer and the second knitted layer comprise a same material and the first exterior of the first knitted layer and the second interior of the second knitted layer are physically coupled via a toe section attachment along at least a portion of the first toe section and the second toe section to form an interface between the first and second knitted layers, and wherein the first and second knitted layers are not physically coupled using the toe section attachment along a remainder of the first exterior of the first knitted layer and the second interior of the second knitted layer;

one or more sub-structural components each having a first surface positioned adjacent to the first exterior of the first knitted layer, a second surface positioned adjacent to the second interior of the second knitted layer, and a peripheral edge extending between the second surface and the first surface, wherein each of the sub-structural components is positioned between the first exterior of the first knitted layer and the second interior of the second knitted layer, wherein the one or more sub-structural components are constructed from a different material than the first knitted layer and the second knitted layer, and wherein the one or more sub-structural components have a substantially rectangular shape;

an overlay attached to a medial side of the second exterior of the second knitted layer and not adjacent to the first knitted layer, where the overlay includes an inner side adjacent to the second exterior of the second knitted layer and an outer side; and a lacing system including a plurality of straps including a plurality of sections woven through the overlay from the inner side and the outer side of the overlay.

12. The upper of claim 11, wherein the one or more sub-structural components are foam or plastic.

13. The upper of claim 11, wherein each of the plurality of straps includes a loop at an end of the strap for a lace.

14. An upper, comprising:

a first knitted layer including a first interior, a first exterior, and a first toe box, wherein the first knitted layer includes a hot-melt fiber;

a second knitted layer distinct from the first knitted layer including a second interior, a second exterior, and a second toe box, wherein the first exterior of the first knitted layer and the second interior of the second knitted layer are physically coupled along at least a portion of the first toe box and the second toe box using an attachment to form an interface between the first and second knitted layers and are not physically coupled using the attachment along a remainder of the first exterior of the first knitted layer and the second interior of the second knitted layer; and one or more sub-structural components each having a first surface positioned adjacent to the first exterior of the first knitted layer, a second surface positioned adjacent to the second interior of the second knitted layer, and a peripheral edge extending between the second surface and the first surface, wherein each of the sub-structural components is positioned between the first exterior of the first knitted layer and the second interior of the second knitted layer, wherein the one or more sub-structural components are constructed from a different material than the first knitted layer and the second knitted layer, wherein the sub- structural components are configured to cover a region of a foot, and wherein the one or more sub-structural components are permanently coupled to at least the first knitted layer with a first hot-melt interface.

15. The upper of claim 14, further comprising a top line seal joining the first knitted layer with the second knitted layer.

16. The upper of claim 14, further comprising an overlay attached to the second exterior of the second knitted layer; and a lacing system including a plurality of straps including sections woven through the overlay from an interior side of the overlay to an exterior side of the overlay.

17. The upper of claim 15, where the top line seal is sealed via a heat bonding adhesive.

18. The upper of claim 14, where the hot-melt fiber is only positioned in one or more specific regions of the first knitted layer adjacent to the one or more sub- structural components.

19. The upper of claim 14, wherein the one or more sub-structural components extend from a side surface to a bottom surface of the upper.

20. The upper of claim 14, wherein the one or more sub-structural components extend to form one or more of a heel portion, a toe cap, and a bridge.

* * * * *